US005195189A

United States Patent [19]

Gibb

[11] Patent Number: 5,195,189

[45] Date of Patent: Mar. 23, 1993

[54] WATER SAVING DEVICE AND METHOD OF USING SAME

[75] Inventor: Robert F. Gibb, San Diego, Calif.

[73] Assignee: The Ambusant Group, Inc., San Diego, Calif.

[21] Appl. No.: 740,793

[22] Filed: Aug. 6, 1991

[51] Int. Cl.[5] ..... E03D 1/14

[52] U.S. Cl. ..... 4/325; 4/393; 4/394

[58] Field of Search ..... 4/324, 325, 378, 392-394, 4/402, 403, 415

[56] References Cited

U.S. PATENT DOCUMENTS

| | | | |
|---|---|---|---|
| 2,214,439 | 9/1940 | Robertson | 4/402 X |
| 2,629,879 | 3/1953 | Bennett | 4/392 |
| 3,296,630 | 1/1967 | Clark | 4/393 X |
| 3,831,204 | 8/1974 | Cook | 4/402 X |
| 4,091,474 | 5/1978 | Makhobey | 4/324 X |
| 4,135,263 | 1/1979 | Anderson | 4/394 X |
| 4,160,294 | 7/1979 | Crumby | 4/394 X |
| 4,365,364 | 12/1982 | Riedel | 4/392 X |
| 4,467,482 | 8/1984 | Dyer | 4/393 |
| 4,499,616 | 2/1985 | Johnson | 4/393 |
| 4,841,580 | 6/1989 | Agostino | 4/404 X |

*Primary Examiner*—Charles E. Phillips

[57] ABSTRACT

A pliable hinged nonbuoyant flapper valve having a frusto conical projection for centering the valve in relation to a toilet drain, and for permitting the flapper valve to contact a toilet drain valve along a continuous line of engagement of seal the toilet valve. A chain connects the flapper valve to a toilet control lever. A ball float having a positive buoyancy slightly greater than the mass of the flapper valve is interposed an an adjusted location between the lever and the flapper valve for holding the flapper valve in an opened position to allow a predetermined volume of water to flow through the toilet drain.

9 Claims, 2 Drawing Sheets

Fig. 1
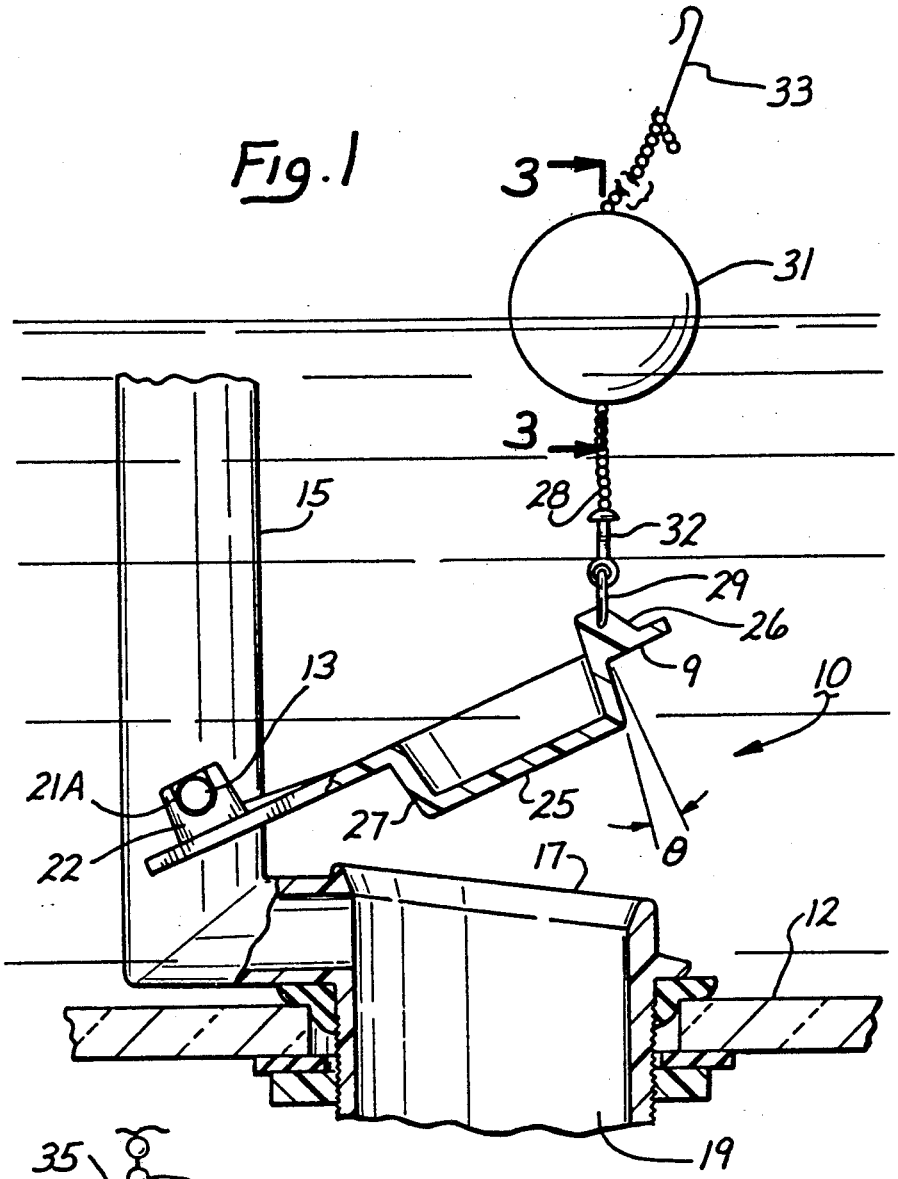
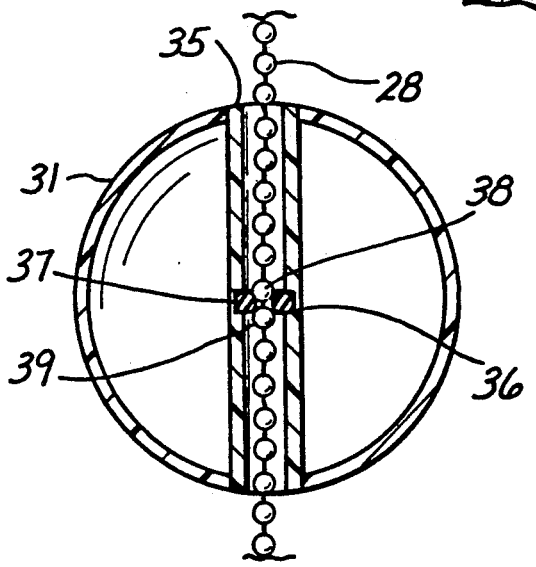
Fig. 3

WATER SAVING DEVICE AND METHOD OF USING SAME

DESCRIPTION

1. Technical Field

The present invention relates generally to a water saving device and a method of using it. More particularly, the invention relates to a water saving device and method for use in a toilet.

2. Background Art

In former times in the United States, fresh water was freely available and was thought by some to be an inexhaustible resource. Many communities provided unlimited supplies of water to commercial and residential consumers at very low cost. Thus, with water conservation having a low priority, little thought was given to it in the design of water using appliances.

Currently, a combination of factors such as rising urban populations, diminishing water tables and near drought conditions in various parts of the country, have combined to diminish the amount of fresh water available to the public. In response to these factors, the public has become aware of the necessity and, in some cases, the urgency of water conservation measures. In this regard, restrictions on water use and increased water rates are being implemented in many communities throughout this country.

As a result of such water conservation efforts now taking place, both voluntarily and as a result of legislation, homeowners and business managers alike are actively seeking ways to conserve the precious resource. Manufacturers of water consuming appliances, such as dishwashers and clothes washers, are developing new products which perform efficiently, while consuming less water than earlier models. As a result, new appliances are gradually replacing the older, less efficient devices as the older ones malfunction and break down. In view of the typical lifespan of such appliances, it is reasonable to expect that a substantial number of older appliances will have been phased out of service over about a ten year period. This will result in significant water conservation.

However, unlike the above mentioned appliances, which require replacement after a relatively short operating life, other water consuming devices remain in use for much longer periods of time. An example is the conventional tank type toilet which is notorious for excessive water consumption. Huge numbers of toilets are in frequent, daily use in homes and businesses. In general, such toilets are very durable and are capable of lasting for exceptionally long periods of time, in some cases, before requiring replacement.

Since many conventional toilets were manufactured at a time when water was more freely available, they were designed without much regard for water conservation. Thus, in such toilets, the storage tank volume can range from five to seven gallons or even more. As a result, every time the toilet is flushed, a large quantity of water is consumed. It will be readily seen that, because of the large capacity of many prior known tank type toilets, huge quantities of water are consumed, on a daily basis.

In spite of the vast quantities of water consumed by toilets, they are often times not replaced with water efficient toilets which require as little as 3.5 or even 1.5 gallons of water for each flush, since replacement is a complicated and expensive process, often requiring the expensive services of a plumber. Thus, the cost of installing a replacement toilet, together with the cost of the new more-efficient toilet, often combine to discourage replacement of a functional toilet, especially if the major objection to it is the fact that it uses excessive amounts of water. Thus, after balancing the benefits of water conservation against the cost of toilet replacement, the homeowner is usually not motivated to replace an inefficient, yet still functioning toilet. For this reason, toilet replacement is postponed, occurring generally during home remodeling, and not at other times.

In summary, it can be expected that in view of the resistance to their replacement, many prior known inefficient toilets may well be in use for the foreseeable future. Thus, it would be very desirable to have an apparatus and method for modifying such toilets to reduce the volume of water such toilets utilize, without diminishing effectiveness of operation.

In response to increased public awareness of the importance of water conservation, and in an attempt to conserve water, a number of toilet water conserving techniques have been developed. It is well known that bricks have been placed in the water storage tank of a conventional toilet to reduce the volume of water therein. Such a primitive approach to water conservation is not very effective because the amount of water saved is not substantial. In addition, the brick sometimes deteriorates in the water environment so that particles break away and foul the plumbing system. Further, volume occupying devices such a brick sometimes interfere with the function of the toilet control elements, such as the trip lever, thereby disrupting toilet operation. For these reasons, water displacement bricks and similar devices, placed in the tank, do not provide a suitable method of water conservation.

In addition to the above-mentioned simple device, specific water flow restricting devices have been developed, for reducing the volume of water utilized each time the toilet is flushed. In this regard, reference may be made to U.S. Pat. No. 4,000,526 which discloses a toilet flushing apparatus. The apparatus includes a flapper valve having a bulbous air retaining chamber. Trapped air in the chamber holds the valve in an opened position during the flushing operation. Before the valve can close, trapped air bleeds from the chamber via large central hole in the chamber. In this regard, when the user elects less than a full flush, a manually operated push button, located in the toilet trip lever assembly, is operated to permit the trapped air to escape prematurely from the chamber. In this manner, the buoyancy of the valve is reduced, and the valve closes before all the water flows from the tank.

A limitation of this invention is the fact that the bulbous flapper valve, having an air chamber, is expensive to manufacture. For example, it does not lend itself to be made by a relatively inexpensive molding process, such as a blow molding process, because the valve has a substantial wall thickness which is not compatible with such a process. Thus, a preferred method of making the buoyant valve is through an injection molding process. However, the process would be relatively expensive because, in order to form the valve, a complex mold must be manufactured to form the air chamber. Thus, such a complex mold required for manufacturing the valve adds to the cost of making it.

The consideration of expense with regard to water saving devices is very important, because many people are affected by the requirement to conserve water. It is recognized that increased water rates are levied against all consumers, including the economically disadvantaged who can least afford higher rates. Thus, the cost of an effective water saving device becomes very important since an inexpensive device can be made more generally available.

With further regard to the above patented device, in order to provide the necessary time delay for the partial flushing operation, a styrofoam float is connected to a trip lever chain for the flapper valve. In this regard, when the air chamber is vented to render the valve non buoyant, the float prevents the valve from closing immediately under the force of gravity. Instead, the styrofoam floats downwardly as the level of water falls within the toilet bowl. In using the apparatus, the amount of water leaving the toilet tank can be adjusted by attaching the float to the chain at an adjusted position.

The patent further teaches that the styrofoam float may be eliminated if a suitable size auxiliary opening is made in the air chamber so that trapped air does escape during a partial flushing operation to provide the desired premature closing of the valve. Thus, it will be seen that the size of the opening is critical. If the opening is a little too large, the trapped air will vent from the chamber more rapidly. In this case, the flapper valve closes before a sufficient quantity of water has left the storage tank for an efficient flushing operation. Thus, repetitive flushing becomes necessary. On the other hand, if the opening is too small, air flow from the chamber is impeded and, as a result, the chamber is more buoyant than desired. Thus, too much water is used, because the valve is held in the opened position for too long a period of time. In either situation, excessive water consumption is the result.

Another disadvantage presented by a requirement for the precisely sized opening is that such openings can become clogged by particles in the water. Thus, over a period of time, especially in areas having "hard" water, deposits can build up in the opening, thereby occluding it and rendering it less effective, or at least not able to provide a desired partial flush of a desired quantity of water. In addition, there is no way of determining in advance what size opening is ideal for a particular toilet water storage tank. Because the shapes and volumes of such tanks differ from one manufacturer to another, a buoyant valve having an ideally sized opening for one toilet configuration, may be unacceptable for other configurations.

In addition to the cost of manufacturing the patented buoyant valve, additional costs are entailed in the use of the patented valve, because of the requirement to modify the toilet trip lever. In this regard, it would be desirable to have a toilet water conserving device which would be compatible with conventional lever assemblies.

In view of the foregoing, it is clear that the apparatus disclosed in U.S. Pat. No. 4,000,526 is unduly expensive to manufacture, and requires precise adjustment for the particular tank volume and configuration in which it is used.

In view of the foregoing, it would be highly desirable to have a toilet water conservation device which could be utilized in toilet tanks of varying sizes and configurations, without any requirement for precise calibration thereof.

In addition to the foregoing limitations presented by the above patented apparatus, such apparatus is designed so that the full flush mode is the usual mode of operation. The user must elect a partial flushing mode when a smaller volume of water is desired. Thus, if the user forgets to activate the air bleed mechanism, the partial flushing principle of the invention is defeated.

Therefore, it would be very desirable to have a toilet flushing apparatus which would cause a partial flushing mode of operation of the toilet, without requiring the user to perform additional or different operations, other than a familiar and conventional manipulation of the toilet trip lever. In addition, such an apparatus would not require the user to select a particular mode of operation.

DISCLOSURE OF INVENTION

It is an object of the present invention to provide a toilet water saving device, for use in a conventional tank toilet, which can be adjusted by the user to deliver a predetermined amount of water in an efficient and convenient manner.

It is another object of the present invention to provide a water saving device which is easily installed by a homeowner, in a conventional toilet without tools, while reducing any need for plumbing skills.

It is a further object of the present invention to provide a water saving device which is easily adjustable for delivering a suitable volume of water in varying toilet tank configuration and sizes.

It is an even still further object of the present invention to provide a water saving device which can be constructed inexpensively, using injection molding techniques.

Briefly, the water saving device of the present invention includes a pliable hinged nonbuoyant flapper valve having a frusto conical projection for centering the valve in relation to a toilet drain, and for permitting the flapper valve to contact a toilet drain valve along a continuous line of engagement to seal the toilet valve. A chain connects the flapper valve to a toilet control lever. A ball float having a positive buoyancy slightly greater than the mass of the flapper valve is interposed at an adjusted location between the lever and the flapper valve for holding the flapper valve in an opened position to allow a predetermined volume of water to flow through the toilet drain.

A significant advantage of the present invention is that it provides a reliable, inexpensive toilet water saving device which is easily installed and readily adjustable to permit delivery of a predetermined volume of water from tanks of different configurations and volumes.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 1 is a side elevational view of the water saving device of the present invention, showing it in its opened position;

FIG. 3 is a sectional view of the float of the device of FIG. 1, taken substantially on line 3—3 thereof;

BEST MODE FOR CARRYING OUT THE INVENTION

Figure 2:
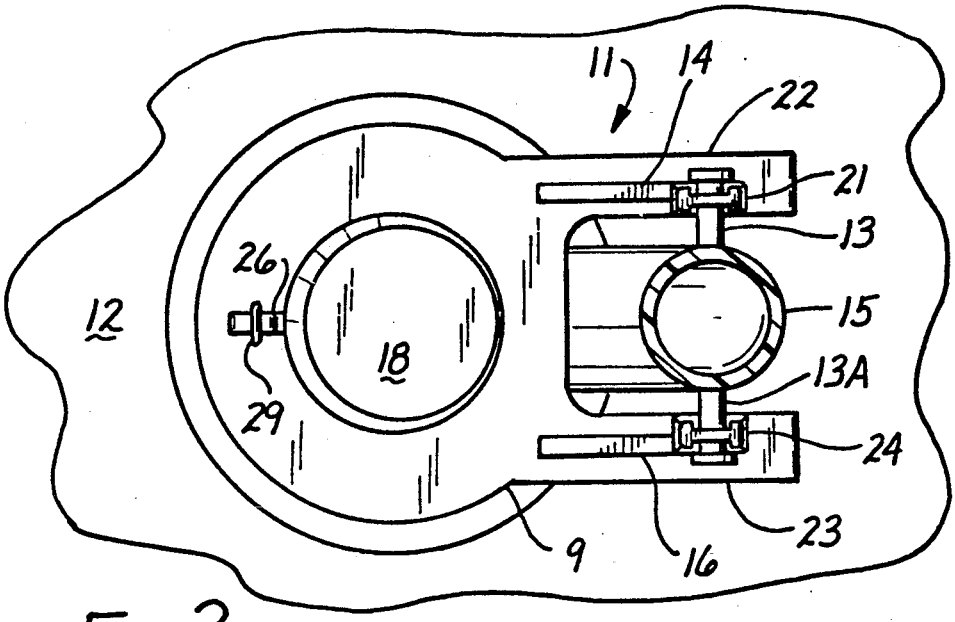
FIG. 2 is a plan view of a toilet water saving device, in the closed position, which is constructed in accordance with the present invention.

Referring now to the drawings, and more particularly to FIGS. 1 and 2 thereof, there is shown a toilet water saving device 10 which is constructed in accordance with the present invention. The device 10 includes a flapper valve assembly 11 which is controlled by a conventional trip lever assembly (not shown) mounted in a toilet water storage tank 12 and connected to the flapper valve assembly 11 by a chain 28. A hollow ball float 31 is disposed on the chain 28 between the trip lever assembly and the flapper valve assembly 11 for limiting the volume of water discharged through a drain 19 each time the toilet is flushed, as hereinafter described in greater detail.

An apertured tab 26 projects upwardly from the valve assembly 11 for engaging a self piercing stainless steal loop 29. A connector 32 connects the loop 29 with the chain 28. At its end opposite the valve assembly 11, the chain 28 is engaged by a hook 33 for adjustably engaging the tank lever assembly (not shown).

Figure 4:
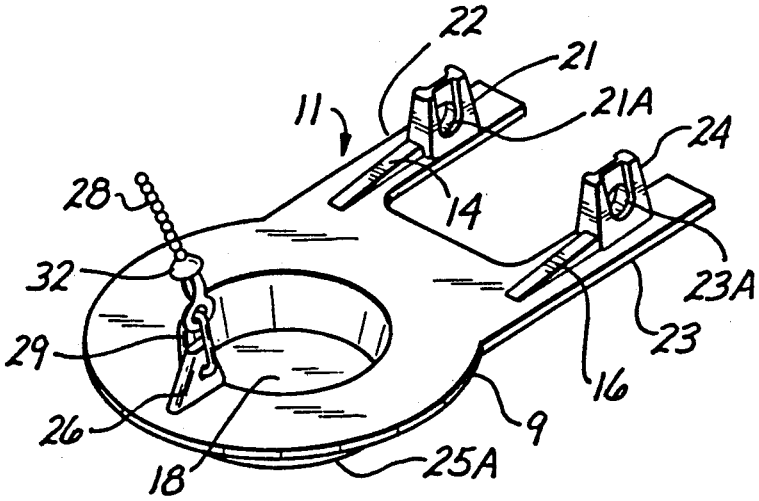
FIG. 4 is a pictorial view of the device of FIG. 1.

Considering now the valve assembly 11, with reference to FIGS. 1, 2 and 4, the assembly 11 is pivotally mounted at lugs on a refill tube 15 such as the lugs 13 and 13A. The valve assembly 11 includes a generally round sealing portion 9 which is adapted for sealing an inclined annular valve seat 17 of the tank drain 19. The drain 19 connects the toilet tank 12 in fluid communication with a toilet bowl (not shown) when the sealing portion 9 is moved out of engagement with the valve seat 17 as the flapper valve assembly 11 pivots about the refill tube lugs 13 and 13A.

The valve assembly 11 is constructed of non buoyant material and is adapted to fall under the force of gravity into sealing engagement with the valve seat 17, at the end of a flushing operation. The chain 28 extends to, and is controlled by, the trip lever assembly (not shown) to pull the flapper assembly 11 upwardly, out of sealing engagement with the valve seat 17, during the flushing operation.

The hollow ball float 31 is movably attached to the chain 28 at an adjusted location between the valve assembly 11 and the trip lever assembly (not shown) to control the volume of water discharged through the drain 19 when the toilet is flushed. In this regard, when the flapper valve assembly 11 is pulled open by the chain 28, the ball float 31 holds the flapper valve assembly 11 in the opened position, thereby preventing it from closing immediately under the force of gravity. The float 31 is attached to the chain 28 at a sufficient distance from the valve assembly 11 to enable the valve assembly to close when the water level in the tank 12 has drained to a desired level, thereby permitting a predetermined volume of water to be flushed from the toilet tank.

Considering now the flapper valve assembly 11 in greater detail with reference to FIG. 4, the flapper valve is molded from polyvinyl elastomeric material having suitable water resistant qualities. In addition, it is resistant to chemicals that are often added to toilet tanks for coloration and cleaning purposes. The flapper valve material has sufficient rigidity to provide good shape retention, yet it is pliable enough to ensure an effective water tight seal when the sealing portion 9 engages the valve seat 17. A pair of parallel, spaced apart arms 22 and 23, composed of the same material as the valve assembly 11, are integrally connected to the sealing portion 9. The arms 22 and 23 enable the assembly 11 to flex slightly when the chain 28 pulls it upwardly into an opened position. The amount of flexion is controlled by stiffening spines 14 and 16 which enable the valve assembly 11 to move against water resistance, from one position to another, in a smooth controlled manner, without distortion. Each of a pair of tabs 21 and 24, projecting upwardly from the arms 22 and 23, respectively, has an opening 21A and 23A, respectively, for engaging the lugs 13 and 13A, on the refill tube 15 to hold pivotally the valve assembly 11.

Considering further the valve assembly 11 with regard to FIG. 1, a frusto conically shaped projection 25 having a tapered side wall 25A depends from the sealing portion 9. The side wall 25A forms an angle $\theta$, of about 2° to about 12°, as measured from a plane perpendicular to the plane of the sealing portion 9. A preferred angle $\theta$ is about 5°. When the valve assembly 11 moves from the opened to the closed position, the projection 25 centers the valve assembly 11 over the valve seat 17 for registration, thereby providing a continuous line of contact between the sealing portion 9 and the valve seat 17, to effect a water tight seal.

The side wall 25A, in addition to its role in registering the valve assembly 11 to provide a water tight seal, also aids in reducing resistance to the flow of water during the flushing operation. In this regard, when the valve assembly 11 has been pivoted upwardly into an opened position, the tapered side wall 25A presents a smoothly contoured, downwardly inclined shelf, to permit water flow thereabout. Thus, drag and resistance are minimized and a more efficient water flow into the drain 19 is achieved.

Considering now the ball float 31 in greater detail, with reference to FIG. 3, the spherical float is constructed of rigid thermoplastic material having a hollow axial tube 35 to permit passage of the chain 28 therethrough. A recess 36, located in about the middle of the tube 35 securely holds an O ring 37 for frictional engagement of beads, such as the beads 38 and 39, for holding the float 31 at an adjusted position on the chain 28. The beads in the chain 28, such as the beads 38 and 39, are of stainless steel and have a diameter of about 0.03 inch. It will be noted that the combination of the O ring 37 and the beads permit small incremental adjustments to the float location, along the chain 28. In addition, the beads confer flexibility and tangle resistance to the chain 28 to insure smooth operation of the valve assembly 11.

Considering now the operation of the water saving device 10 of the present invention, prior to the flushing operation, the valve assembly 11 is in the closed position against the valve seat 17 to retain water in the tank 12. It will be noted that, prior to the flushing operation, the ball float 31 has been located along the chain 28 at a suitable place to allow delivery of a predetermined volume of water. The ball float 31 is submerged in the water. The portion of the chain 28 between the valve assembly 11 and the ball float 31 is in tension while the portion of the chain 28 between the ball float 31 and the trip lever assembly (not shown) is slack. When the trip lever assembly (not shown) is activated, the chain 28 is put under tension throughout its length and the valve assembly 11 is pivotally raised away from the valve seat 17 to allow water to flow from the tank 12 into the drain 19. After the valve assembly 11 is raised, the trip lever is released and the upper portion of the chain 28 returns to its slack condition. It should be noted that, throughout the flushing operation, the lower portion of the chain 28, between the ball float 31 and the valve assembly 11 remains in tension. During the flushing operation, the water level in the tank 12 drops until the ball float 31 is no longer submerged, at which point the valve assembly 11 begins to close. At the time the ball float 31 is almost completely at the water level, the projection 25 registers the sealing portion 9 for sealing engagement with the valve seat 17. At this time, a volume of water remains in the tank 12 up to the level of the float 31. Thus, it will be readily seen that the volume of water delivered per flush is controlled by the height of the ball float 31 on the chain 28 and that the higher the float is on the chain, the greater the volume remaining in the tank 12 after flushing. After the flushing operation, conventional apparatus disposed within the tank 12 enables water to flow into the tank 12 to replenish the water supply. During this refilling operation, water enters the drain 19 via the refill tube 15 to supply water to the toilet bowl in a conventional manner.

During the above described flushing operation, the ball float 31 provides buoyancy to hold the valve assembly 11 in the opened position, since the assembly is nonbuoyant. Thus, the weight of the valve assembly, and ball float size and buoyancy must be considered. In a preferred form of the invention, the weight of the valve assembly 11 is about 0.364 oz and it has been found that suitable dimensions for the ball float 31 are a weight of about 0.296 oz and a volume of about 1.77 $in^3$. When the ball float 31 is submerged, the weight of the water displaced is about 0.98 oz. Thus, the positive buoyancy of the float 31 is about 0.6 oz (0.98–0.296). It has been determined that the force sufficient to hold the valve assembly 11 in the opened position, after it has been raised by the trip lever assembly, is about 0.5 oz.

The ball float 31 easily holds the valve assembly 11 in the opened position. In this regard, because of the nonbuoyancy of the valve assembly 11, the sole factor determining early closing time of the assembly—before all the water has drained from the tank 12—is the ball float 31.

On the other hand, the force holding the valve assembly 11 in the closed position may be calculated when it is considered that a diameter of a typical drain 19 is about 2.17 inches thus providing a drain area ($\pi r^2$) of about 3.8 $in^2$. Thus, even when there is less than about one-quarter inch of water in the storage tank, the force of the water, together with the weight of the valve assembly 11, is greater than the buoyant force exerted by the ball float 31. Thus, the valve assembly 11 remains securely closed as the tank 12 fills with water.

While the flushing operation described above is the one most commonly used, the user may sometimes desire a larger flush wherein substantially all of the water in the tank 12 flows into the drain 19. In this case, the user may hold the trip lever assembly (not shown) in the operating position for the time it takes for the water to flow out of the tank 12. In this case, closure of the valve assembly 11 is not controlled by the ball float 31 but, instead, the assembly 11 moves into the closing position because of its own weight. In this regard, a tapered cup 18 on the upper surface of the valve assembly 11, opposite the projection 25, accumulates water as the valve assembly 11 moves toward the closing position. The water accumulated in the cup 18 adds to the weight of the valve assembly 11, thereby contributing to the formation a water tight seal between the water valve assembly 11 and the valve seat 17.

Figure 5:
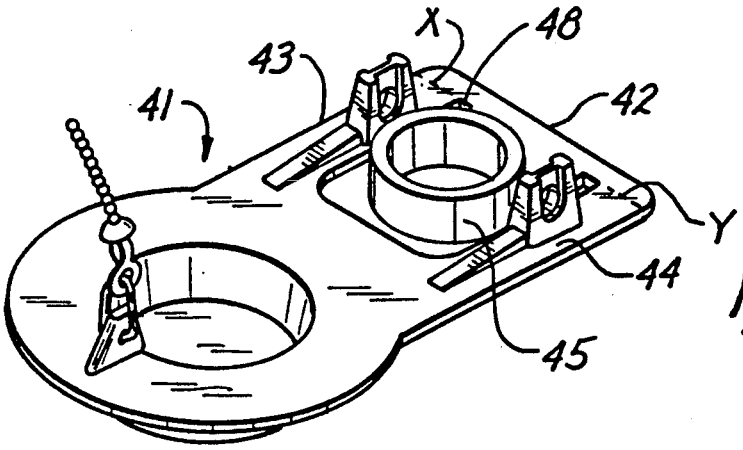
FIG. 5 is a pictorial view of another toilet water saving device, which is constructed in accordance with the present invention.

With reference now to FIG. 5, there is shown a flapper valve assembly 41, which is also constructed according to the present invention. The assembly 41 is similar to the valve assembly 11 except that the assembly 41 has a elastomeric web 42 having a refill tube engaging ring 45 interposed between arms 43 and 44. The arms 43 and 44, together with a portion of the web 42, define a U-shaped opening 48. The valve assembly 41 is adapted to be used in toilet tanks having a refill tube without lugs. In such a case, the ring 45 may be slipped down the refill tube until the valve assembly 41 is suitably located within the toilet tank. The design of the valve assembly 41 provides the consumer with flexibility. When lugs are present on the refill tube, the user may use a conventional pair of scissors to cut the arms 43 and 44 transversely along the lines X and Y, respectively, into the slot 48 to separate the web 42 and the ring 45. With the web and ring thus removed, the valve assembly 41 is identical to the valve assembly 11.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A toilet water saving device comprising:

a pliable hinged non buoyant flapper valve including a sealing surface having a frusto conical projection for registering said valve in relation to a toilet drain and for permitting said flapper valve to contact sealingly a toilet drain valve seat along a continuous line of engagement;

a chain connecting said flapper valve to a toilet control lever;

a ball float interposed on said chain between said lever and said flapper valve for holding said flapper valve in an opened position to allow a predetermined volume of water to flow through said drain, said float having a positive buoyancy slightly greater than the mass of said flapper valve; and means for fixing frictionally said float at an adjusted position on said chain wherein said float includes an axially disposed round tube for disposition therethrough of said chain and said fixing means includes a pliant O-ring disposed within said tube for frictionally engaging said chain.

2. A device of claim 1 wherein said projection has a tapered side wall, said wall defining an angle $\theta$ of between about 2° and about 12° where $\theta$ is the angle formed by the side wall and said valve surface.

3. A device of claim 1 wherein $\theta$ is about 5°.

4. A device of claim 1 including a beaded chain.

5. A device of claim 1 including a pair of spaced apart arms to adapt said flapper valve to be pivotally mounted to a toilet refill tube.

6. A device of claim 1 said flapper valve having water retaining means disposed on an upper surface thereof for increasing the weight of said flapper valve to aid in registering said valve in relation to said drain and to aid in permitting said flapper valve to contact sealingly said toilet drain valve.

7. A device of claim 1 wherein said retaining means is cup shaped.

8. A device of claim 1 including ring means for pivotally mounting said flapper valve to a toilet refill tube.

9. A method of using a toilet water saving device having a pliable hinged non buoyant flapper valve including a sealing surface having a frusto conical projection for registering said valve in relation to a toilet drain and for permitting said flapper valve to contact sealingly a toilet drain valve seat along a continuous line of engagement, a chain connecting said flapper valve to a toilet control lever, a ball float interposed on said chain between said lever and said flapper valve for holding said flapper valve in an opened position to allow a predetermined volume of water to flow through said drain, said float having a positive buoyancy slightly greater than the mass of said flapper valve, and means for fixing frictionally said float at an adjusted position on said chain wherein said float includes an axially disposed round tube for disposition therethrough of said chain and said fixing means includes a pliant O-ring disposed within said tube for frictionally engaging said chain comprising:

determining a suitable water volume for each flush;

connecting the flapper valve to a toilet control lever;

pivotally connecting the flapper valve to a toilet refill tube; and locating the float between the flapper valve and the lever wherein said locating includes positioning said float for delivery of the determined water volume.

* * * * *